US006760986B1

(12) United States Patent
MacNeil

(10) Patent No.: US 6,760,986 B1
(45) Date of Patent: Jul. 13, 2004

(54) VEHICLE LICENSE PLATE COVER

(76) Inventor: David F. MacNeil, 205 E. Sixth St., Hinsdale, IL (US) 60521

( * ) Notice: Subject to any disclaimer, the term of this patent is extended or adjusted under 35 U.S.C. 154(b) by 0 days.

(21) Appl. No.: 10/151,361

(22) Filed: May 17, 2002

(51) Int. Cl.[7] ..... G09F 7/00
(52) U.S. Cl. ..... 40/200; 277/641
(58) Field of Search ..... 40/200, 209, 661, 40/578, 718; 277/641, 642, 643, 647, 648, 628; 220/221, 795, 803, 804; 215/343, 344, 345, 352

(56) References Cited

U.S. PATENT DOCUMENTS 1,664,302 A * 3/1928 Leopold et al. ..... 40/205
2,130,090 A * 9/1938 Imhofe ..... 362/478
2,144,261 A * 1/1939 Johnston ..... 116/305
3,894,371 A * 7/1975 Yamaha ..... 52/209
4,123,071 A * 10/1978 Yamamoto ..... 277/642
4,182,062 A * 1/1980 Krokos et al. ..... 40/209
4,308,965 A * 1/1982 Dutt ..... 215/345
4,331,249 A * 5/1982 Banich, Sr. ..... 215/343
4,379,512 A * 4/1983 Ohmi et al. ..... 215/327
4,415,096 A * 11/1983 Ohmi ..... 215/343
4,813,167 A * 3/1989 Means ..... 40/210
5,226,251 A * 7/1993 Webb ..... 40/508
5,440,849 A * 8/1995 Agrawal et al. ..... 52/393
5,918,393 A * 7/1999 Martell ..... 40/1
5,947,311 A * 9/1999 Gregory ..... 215/341
6,202,872 B1 * 3/2001 Smeyak et al. ..... 215/343

OTHER PUBLICATIONS

Screen print of Internet Website: www.macneilauto.com/store/frames.html.

* cited by examiner

*Primary Examiner*—Brian K. Green
(74) *Attorney, Agent, or Firm*—Jefferson Perkins Daspin & Aument, LLP

(57) ABSTRACT

A license plate cover has a transparent plastic frame and an elastomeric gasket. The frame includes a periphery and an inner side for disposal adjacent to a license plate. The elastomeric gasket is disposed on the inner side near the periphery of the frame. The gasket includes first and second elongate compression ribs which protrude inwardly from the inner side of the frame to different degrees thereby forming a surface that receives a beveled license plate. The elastomer making up the gasket may be furnished with a colorant such that a colored peripheral band is visible through the frame from the front.

13 Claims, 4 Drawing Sheets

VEHICLE LICENSE PLATE COVER

TECHNICAL FIELD OF THE INVENTION

The present invention relates in general to a protective covering, and more particularly to a license plate cover for protecting a license plate from rain, slush, salt, debris and other adverse elements found in the highway environment.

BACKGROUND OF THE INVENTION

When a vehicle is driven or parked outside, the vehicle license plate is exposed to chemical, abrasive and actinic attack from causes such as water; aqueous solutions of harsh chemicals, notably road salt; organics such as road tar; abrasive particulates, typically silicates; macroscopic debris such as pebbles and insects; ozone; and solar and heat radiation, the former of which includes aging ultraviolet radiation. Optimally, the outside surface of a highway vehicle must withstand combinations of these adverse environmental actors, even as the vehicle is moving through the air at 65 mph or greater. The environment near the highway surface can be particularly unforgiving.

Government-issued vehicle identification plates may not be as weather-impervious as the rest of the vehicle, and without protection one often sees license plates which have been sand-blasted, etched, mangled and sun-faded on otherwise presentable vehicles. Further, the fasteners that attach the license plate to the vehicle may rust. As a result, the license plate may become difficult to remove.

License plate covers have been used to protect license plates from these damaging environmental factors. Generally, conventional license plate covers do not have a seal positioned around the rim of the cover to protect the license plate. However, a license plate cover made by Altec includes as a separate component, a circumferential gasket for positioning around the edge of the cover. The Altec license plate cover also includes, as separate pieces, compression-limiting sleeve inserts used in each of the screw holes in order to ensure that the screws do not overcompress the gasket and fracture the frame member. Prior license plate covers also include rubber mounting caps that are used to cover the fasteners that attach the license plate and license plate cover to the vehicle. Prior license plate covers, however, fail to provide an adequate seal that prevents unwanted elements from damaging the license plate or fasteners. As a result, a need exists to provide an improved license plate cover that adequately seals a license plate from various environmental elements.

License plate covers have also been provided with circumferential bands or borders of color to complement the vehicle basic or trim color. Such a border has been painted on the external side of the license plate cover, where it is subject to gradual removal by abrasion, or has been painted on the interior side where it may be viewed through the transparent cover. While painting a color band on the interior side is an improvement, it still represents a separate manufacturing and material cost increment over covers without such a color band or border or which use no such paint or coating.

SUMMARY OF THE INVENTION

According to one aspect of the invention, a license plate cover is provided to protect a license plate from various environmental elements. An elastomeric gasket is disposed on the inner side near the periphery of the frame of the license plate. The gasket has a first and a second elongate compression rib which protrude inwardly from the inner side of the frame to different degrees. The elongate compression ribs are positioned so that they are adjacent to the (typically bilevel and beveled) license plate when installed on a vehicle, thereby protecting the license plate surface and sealing the mounting screws or other fasteners.

According to another aspect of the invention, a license plate cover is provided in various colors. The license plate cover frame is transparent and has an inner side with a channel. A colored elastomeric gasket is injection molded into the channel. As a result, a consumer-selectable band of color is perfectly transmitted through the transparent cover visible from the front, but is not easily attacked by the elements itself, and therefore persists in like-new condition. The separate step and material cost of painting a color band on the cover is avoided.

BRIEF DESCRIPTION OF THE DRAWINGS

Further aspects of the invention and their advantages may be discerned from the following description when taken in conjunction with the drawings, in which like characters identify like parts and in which.

DETAILED DESCRIPTION

Figure 1:
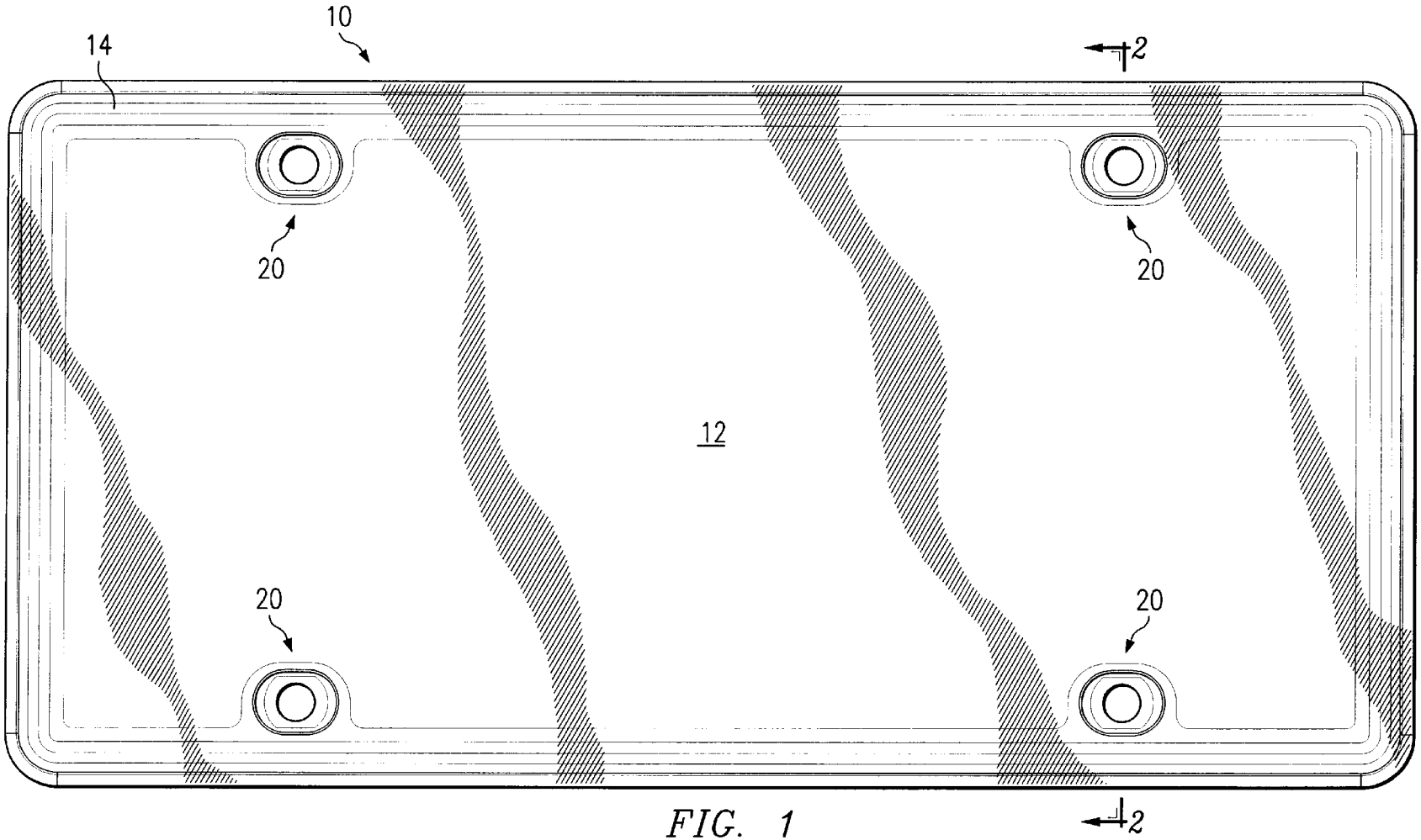
FIG. 1 is a front plan view of the license plate cover of the present invention.
Figure 5:
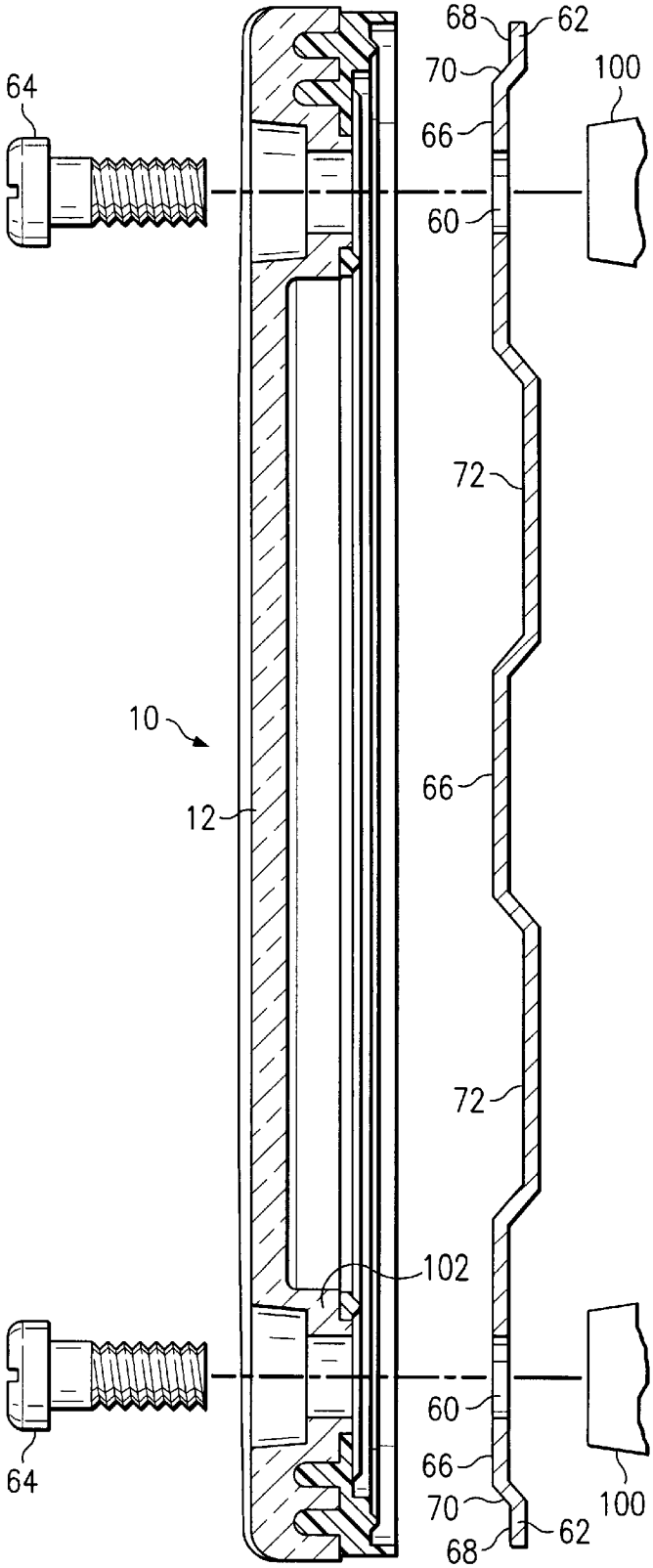
FIG. 5 is an exploded side view of the license plate cover of FIG. 1 showing installation on a license plate.

In FIG. 1, the front license plate cover indicated generally at 10 is rectangular and is sized to overlap a vehicle license plate (see FIG. 5). The license plate cover 10 includes a frame 12 with a periphery 14 and a gasket 40 formed from a natural or synthetic elastomer best seen in FIGS. 2, 3 and 4. The gasket 40 is positioned in the inner side 30 of the frame 12 along the periphery 14 of the frame 12. The frame 12 is transparent and formed from a tough plastic material, such as an acrylic or polycarbonate.

The frame 12 includes mounting holes 20, typically four in number, that align with the holes in a conventional license plate and a vehicle license plate mounting bracket. The mounting holes 20 are configured to receive a fastener 64, such as a bolt, to secure the license plate cover 10 to a vehicle (see FIG. 5). Each mounting hole 20 includes a stepped or double level opening (see FIGS. 2 and 3).

Figure 2:
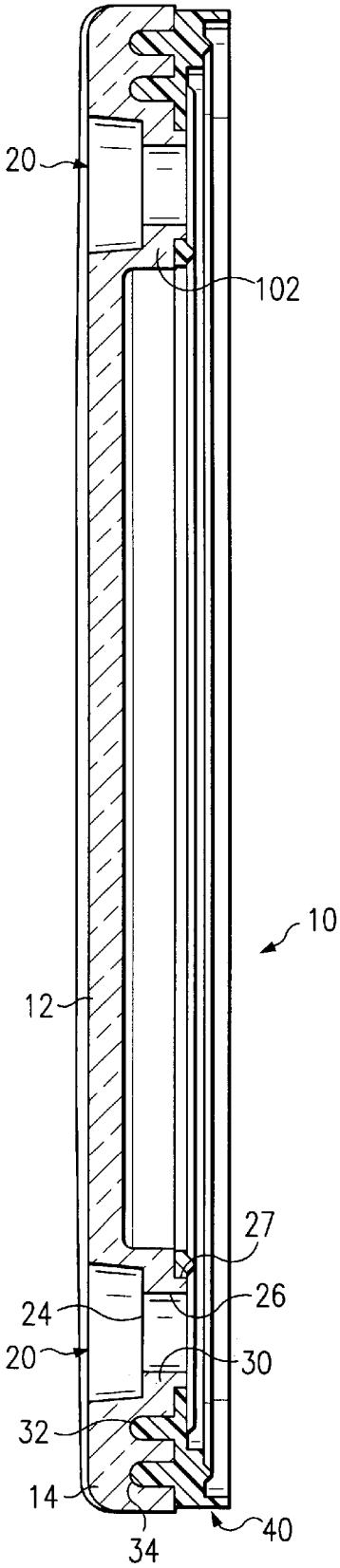
FIG. 2 is a cross sectional side view taken substantially along line 2—2 of FIG. 1.
Figure 3:
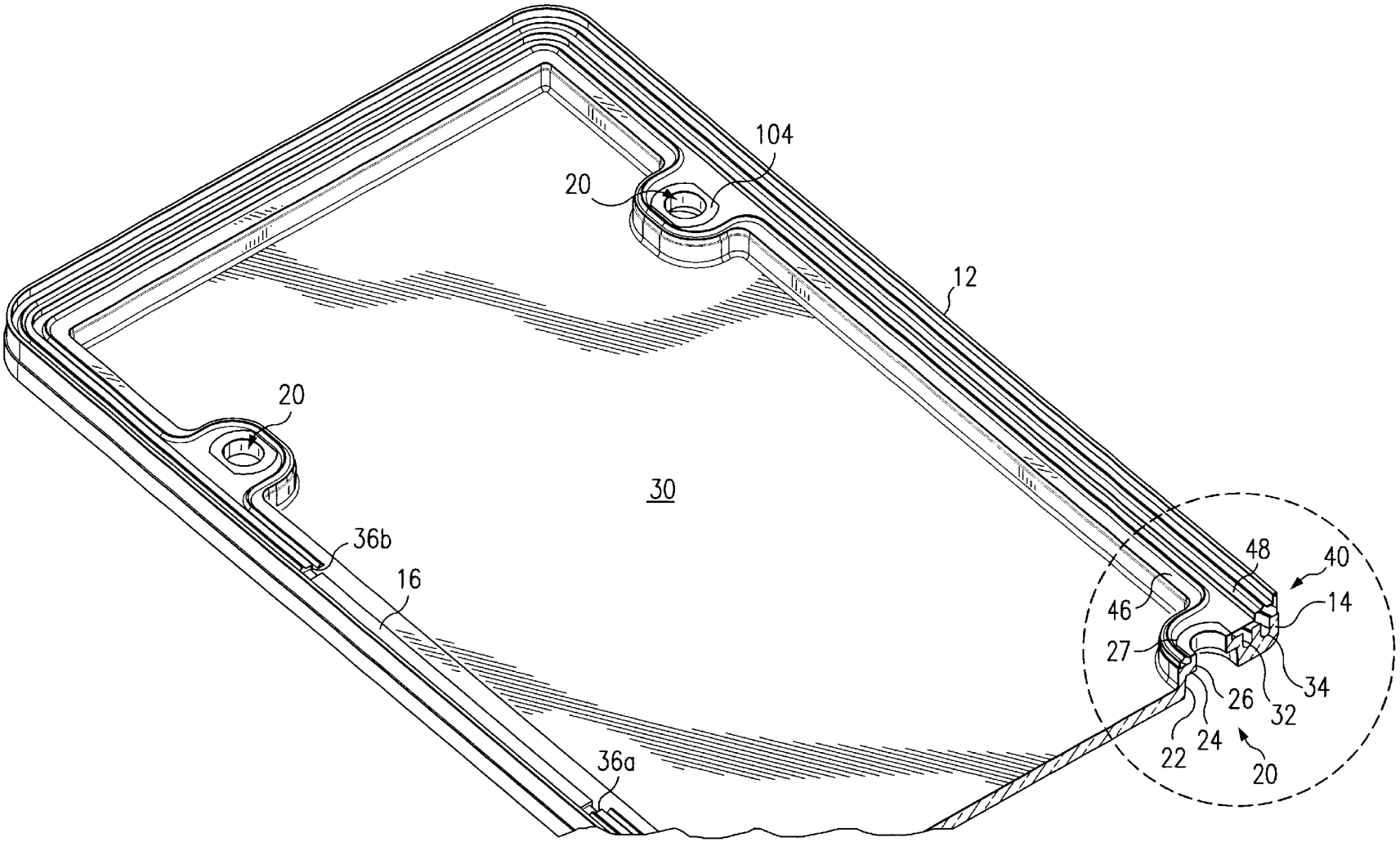
FIG. 3 is a partial rear isometric view of the license plate cover illustrated in FIG. 1.
Figure 4:
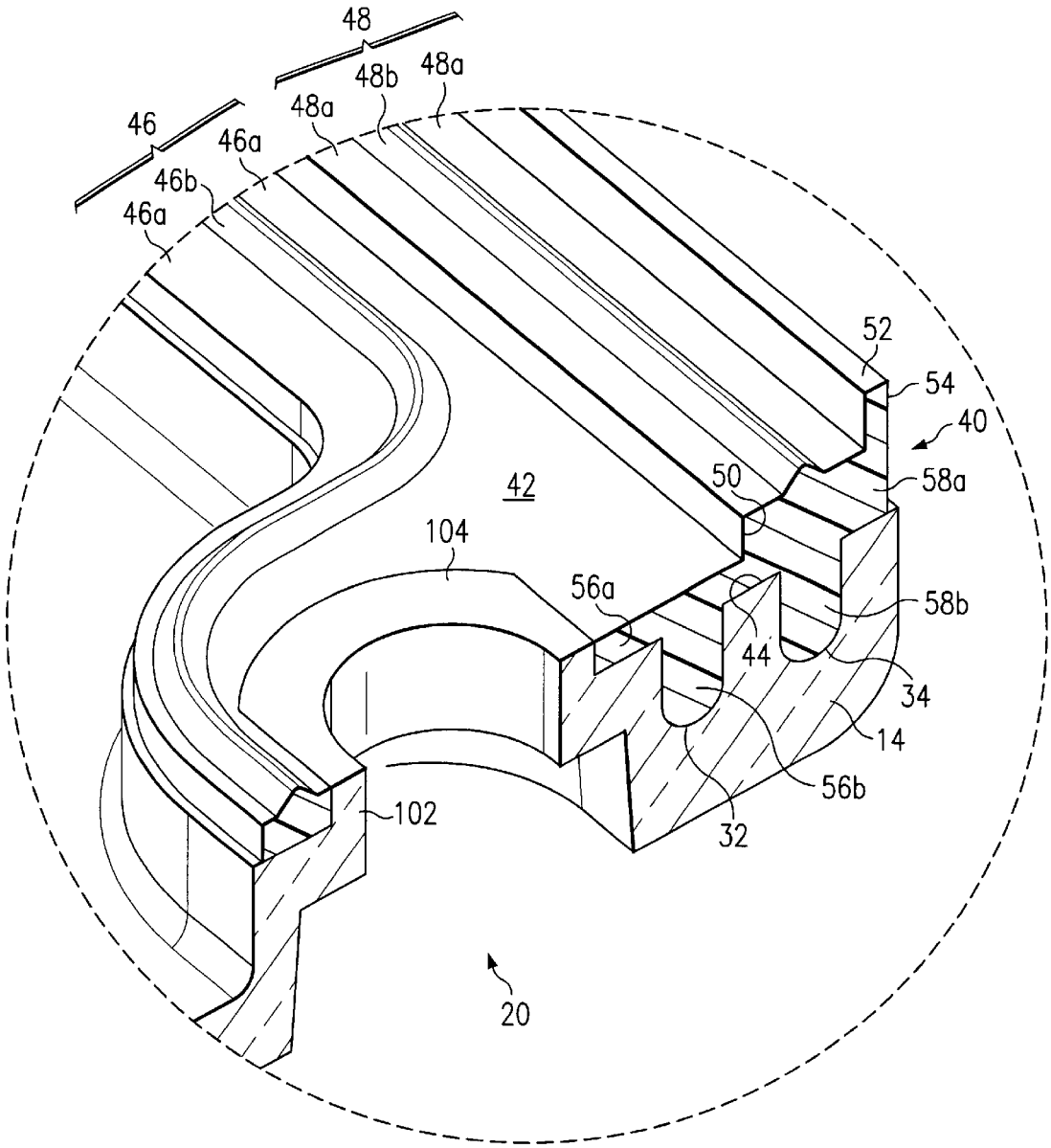
FIG. 4 is a sectional detail of the gasket in the frame of the license plate cover illustrated in FIG. 1.

FIGS. 2, 3 and 4 illustrate the inner side 30 of the frame 12. The inner side 30 of the frame 12 includes two channels 32 and 34 located near the periphery 14 of the frame 12. An elastomer is injection molded into the channels 32 and 34 to form the gasket 40. As shown in FIG. 3, the gasket 40 also surrounds the mounting holes 20 thereby supplying a peripheral seal to the mounting holes 20. In a preferred embodiment, the frame 12 and the gasket 40 are formed in the same mold by a two-shot injection molding process.

The channels 32 and 34 extend around all or a substantial portion of the periphery 14 of the frame 12.

FIGS. 2, 3 and 4 also illustrate the stepped or double level mounting holes 20 that are positioned in the frame 12. The first level 22 of the mounting hole 20 has an oblong shape with a varying width that narrows as it approaches the inner side 30 of the frame 12. The first level 22 and second level 26 meet at step 24. The step 24 is located at approximately the middle of the depth of the frame 12. The second level 26 of the mounting hole 20 has a circular shape and is configured to receive the shank or body of a fastener 64. The second level 26 of mounting hole 24 is defined by an enclosing sidewall 102 of relatively incompressible, hard plastic material which extends from the step 24 to a surface 104 which is substantially coplanar with general interior gasket surface 46*a* (described below). The enclosing sidewall 102 acts as a compression delimiter; the mounting screws will be able to compress only upstanding gasket ribs 46*b*, 48*b*, but not the remainder of the gasket body. Enclosing sidewalls 102 prevent the fasteners from overcompressing the gasket and fracturing the frame of the license plate cover.

After the fastener 64 (See FIG. 5) is installed, mounting hole 20 is filled with the fastener head and a rubber mounting cap. The mounting cap (not shown) surrounds and seals the fastener so as to protect it from environmental attack. The shape of the openings of each level of the mounting holes may also vary; for example, the first level opening could also be circular.

FIG. 4 is a detail of a preferred form of a gasket 40 that is installed in the license plate cover of the present invention. The gasket 40 is formed from an elastomer, such as saniprene, or another organic rubber with an ultraviolet inhibitor. A suitable elastomer is Multi-Flex® TEA from Multibase. When the gasket is injection molded into the channels 32 and 34 of the transparent license plate cover frame, the front of the license plate cover displays the color of the gasket, which can be chosen to be clear or a transparent color. As the gasket is injection molded into the frame, the liquid elastomer adheres to or "wets" the surface of the channels and the frame such that a complete molecular interface is formed between the gasket and the frame. Thus, the gasket completely contacts the inner surface of the channels and the frame. Since there are no air gaps, there will be no refraction or light scattering at the gasket/cover interface, and there will be virtually complete light transmission through the frame member from the gasket surface. As a result, the license plate cover as viewed from the outside has a consistently colored border of undiminished hue.

The gasket 40 may be colored by a variety of colors, including clear or transparent, so that the user may select a license plate cover that matches (or pleasingly contrasts with) the color of his or her vehicle. Preferably, the mounting caps are also colored to match the color of the gasket 40. Because the colored piece is disposed behind the tough, transparent frame 12, it will not be worn or abraded, will be less subject to chemical attack and therefore will retain its initial brightness longer. The gasket 40 thus provides a colored band without the additional step of applying paint to either the inside or the outside of frame member 12.

The gasket 40 includes a license plate receiving surface 42 and an opposed frame mounting or retaining surface 44. The receiving surface 42 includes a first section 46 and a second section 48. The first section 46 and the second section 48 are separated by a step 50. In a preferred embodiment, the step 50 is approximately 0.05 inches to 0.10 inches high. As a result, the second section 48 is positioned in a plane above that of the first section 46 as illustrated in FIGS. 3 and 4. In use, the step 50 is disposed adjacent to a license plate when the license plate cover is installed over the license plate on a vehicle (See FIG. 5).

Each receiving surface section 46 and 48 includes a substantially flat surface section 46*a* and 48*a*, respectively. Each flat surface section 46*a* and 48*a* also includes an elongated upstanding compression rib 46*b* or 48*b*. The compression ribs 46*b* and 48*b* protrude inwardly from the rear of the frame to intentionally different heights so that the compression ribs 46*b* and 48*b* are disposed to be adjacent respectively to a raised central area 66 and a depressed peripheral area 68 of a license plate (FIG. 5). The inwardmost surface of compression rib 48*b* is oriented in a plane inward relative to an inwardmost surface of compression rib 46*b*. Compression rib 46*b* is centered over the channel 32 except for the area under the mounting holes. At each mounting hole, the compression rib 46*b* extends from its location above channel 32 laterally inwardly around the outer periphery of the mounting hole. At the opposite side of the mounting hole, the compression rib 46*b* resumes its position over the channel 32. The compression rib 48*b* is centered over the channel 34. As best shown in FIGS. 4 and 5, the routing of inner compression rib 46*b* to the interior of the mounting holes provides a further anticorrosion barrier for the fasteners.

As best seen in FIG. 3, the peripheral compression ribs 46*b*, 48*b* seal most of the periphery of the frame, but not all of it. A gap 16 and drain channels 36*a* and 36*b* are intentionally left open on the bottom center of the cover. This is to permit air pressure equalization when the vehicle changes altitude, and provides a gravity drain for any moisture which may have found its way under the cover 10.

The receiving surface 42 of the gasket 40 also includes a raised rim 52 which forms the outer edge 54 of the gasket 40. The raised rim 52 is in a plane inward that of the compression ribs 46*b* and 48*b*. The raised rim is located around the periphery of the gasket 40. Thus, the raised rim 52 fits over and around an outer edge of the license plate when installed over the license plate of a vehicle.

The compression ribs 46*b* and 48*b* have a triangular or inverted V-shape. The sections of the compression ribs 46*b* and 48*b*, however, could be formed from other shapes, such as a circle or an ellipse. In addition to the raised rim 52, the compression ribs 46*b* and 48*b* provide a barrier to the environmental elements, including rain and slush.

The mounting surface 44 of the gasket 40 closely (and preferably, exactly) conforms to the shape of the channels 32 and 34 and the inner side 30 of the frame 12. In the preferred embodiment, this is accomplished automatically by using a two-step injection molding process, in which the channels 32 and 34 are formed in a first step and are filled with a fluid elastomer in a second step. Thus, the mounting surface 44 surrounds the mounting holes 20 and fills the channels 32 and 34 in the frame 12. The mounting surface 44 also includes rectangular sections 56*a* and 58*a* positioned above and connected to the portions 56*b* and 58*b* that fill the channels 32 and 34. The first rectangular section 56*a* is adjacent to the first receiving section 46 and the second rectangular section 58*a* is adjacent to the second receiving section 48. As shown in FIGS. 3 and 4, the second rectangular section 58*a* is approximately 0.05 to 0.10 inches higher than the first rectangular section 56*a*.

Filling double channels 32 and 34 with injection molded elastomer militates against the delamination of the gasket 40 from the plastic frame member 12. The channels 32 and 34 provide a greater surface area for frictional gripping of the gasket 40 onto the frame member 12, and also provide physical obstructions to lateral dislocation of the gasket 40 relative to the frame 12. In less preferred embodiments, however, the complex retaining surface 40 and channels 32, 34 could be replaced with a single-channel construction or even flat frame and gasket surfaces which could be bonded together by, e.g., an adhesive. As mentioned above, the gasket 40 should "wet" the inner surface 30 of frame 12 for optimum light transmission.

FIG. 5 illustrates the license plate cover 10 relative to a license plate 60 and vehicle frame mounting bracket portions 100. The border 62 of the license plate contacts the compression ribs 46*b* and 48*b*. Conventional license plates are stamped or embossed to leave a raised central area 66 and a relatively depressed peripheral area 68, with a bevel or step 70 in between. The letters and numbers 72 of the vehicle license plate and other indicia are stamped into raised central area 66. The different elevations of ribs 46*b* and 48*b* allow them to respectively mate with the raised central area 66 and the depressed peripheral area 68. This improves the seal and prevents buckling or warping of the license plate by the cover 10. The stepped compression ribs 46*b* and 48*b* and the raised rim 52 of the gasket 40 provide a seal that protects the license plate and the fasteners that attach the license plate from damaging environmental elements.

In summary, a vehicle license plate cover has been described and illustrated which provides for a sealing engagement to a beveled license plate and a peripheral band of color that is protected from the elements. However, while the invention has been described with respect to the illustrated embodiment, it is not limited thereto, but only by the scope and spirit of the appended claims.

I claim:

1. A license plate cover, comprising:

a frame having a periphery and an inner side for disposal adjacent a license plate;

an elongated elastomeric gasket disposed on the inner side near the frame periphery and having:

first and second elongate compression ribs formed to extend inwardly from the inner side of the frame, a periphery, and a raised rim in a plane inward that of the first and second compression ribs, wherein the raised rim is located around the periphery of the gasket; and a plurality of holes for receiving respective fasteners to a vehicle license plate mounting bracket, the gasket laterally surrounding the holes.

2. The license plate cover of claim 1, wherein an inwardmost surface of the second compression rib is oriented in a plane inward relative to an inwardmost surface of the first compression rib.

3. The license plate cover of claim 1, wherein both said elongate compression ribs are V-shaped.

4. The license plate cover of claim 1, wherein the inner side of the frame includes at least one elongate channel, the elastomeric gasket being injection molded into the channel.

5. The license plate cover of claim 1, wherein the frame has an outer side, the plurality of holes each including a stepped opening with a first level and a second level formed inwardly from the first level, each hole having a sidewall of nongasket material extending at least from the second level to the inner side, wherein said sidewalls prevent the fasteners from overcompressing the gasket and fracturing the frame.

6. The license plate cover of claim 1, wherein the raised rim of the gasket surrounds a majority of the frame leaving a bottom portion open.

7. The license plate cover of claim 6, wherein the bottom portion of the raised rim is sufficiently open for permitting air pressure equalization and for enabling moisture to escape.

8. The license plate cover of claim 1, wherein the second compression rib is disposed laterally exteriorly of the first compression rib.

9. The license plate cover of claim 1, wherein the inner side of the frame includes two elongate channels, the elastomeric gasket being molded into both said channels.

10. The license plate cover of claim 1, wherein said frame is transparent and has a front, an outer side and said inner side, the inner side of the transparent frame includes at least one elongate channel; and wherein said gasket is colored and injection molded into the channel so as to closely adhere to the inner side of the frame such that a band of color is visible through the frame from the front of the license plate cover.

11. The license plate cover of claim 10, wherein the gasket is formed from a rubber with an ultraviolet inhibitor.

12. A vehicle license plate cover, comprising:

a frame member having an inner surface for disposal proximate a vehicle license plate and an outer surface opposed to the inner surface for disposal remote from the vehicle license plate, at least a central region of the frame member being transparent such that a viewer can view a license plate through the central region;

a plurality of mounting holes formed to extend through the frame member from the outer surface to the inner surface at respective locations peripheral to the central region;

an elongated elastomeric gasket formed on the inner surface of the frame member peripheral to the central region of the frame member; and an elongate first rib of the gasket extending inwardly away from the inner surface of the frame member, a path of the first rib disposed laterally inwardly of the mounting holes such that at least a portion of the first rib is disposed between the mounting holes and the central region.

13. The vehicle license plate cover of claim 12, further comprising an elongate second rib of the gasket which extends inwardly away from the inner surface of the frame member, a path of the second rib disposed laterally exteriorly of the mounting holes.

* * * * *